United States Patent [19]

Conger et al.

[11] 4,112,820

[45] Sep. 12, 1978

[54] TAMPER-PROOF AXIAL TUMBLER TYPE LOCK

[75] Inventors: William H. Conger; Ronald F. Gehringer, both of Sioux Falls, S. Dak.

[73] Assignee: Nordica International, Inc., Sioux Falls, S. Dak. ; a part interest

[21] Appl. No.: 854,330

[22] Filed: Nov. 23, 1977

[51] Int. Cl.[2] ..... E05B 15/14; E05B 19/02; E05B 27/08

[52] U.S. Cl. ..... 70/363; 70/404; 70/421

[58] Field of Search ..... 70/303, 403, 404, 419, 70/421

[56] References Cited

U.S. PATENT DOCUMENTS

| | | | |
|---|---|---|---|
| 3,813,906 | 6/1974 | Kerr | 70/303 |
| 3,916,657 | 11/1975 | Steinbach | 70/303 |
| 4,006,615 | 2/1977 | Szova | 70/303 |

*Primary Examiner*—Robert L. Wolfe

*Attorney, Agent, or Firm*—D. Paul Weaver

[57] ABSTRACT

An axial tumbler type lock having a split cylinder within a stationary lock casing contains a set of regular spring-urged split tumblers which bridge the shear line to render the lock active and which are depressed to the shear line by a tubular key to allow turning of the lock to a release position. A modified split tumbler with a reduced forward pin extension also bridges the shear line of the lock and responds only to a special key having a forward pin extension for depressing the special split tumbler to the shear line. Additionally, the lock possesses one or more hidden tumblers in the non-rotational lock cylinder section which are spring-urged and have the capability of moving forwardly into the pocket for the special tumbler or into the pockets of any of the regular tumblers if the proper key is not employed to depress the special tumbler to the shear line, or if the rotational section of the lock cylinder is somehow turned without the proper key in place. Simplicity of construction and adaptability of the invention to a well-known "Ace" lock are featured.

4 Claims, 9 Drawing Figures

FIG. 4
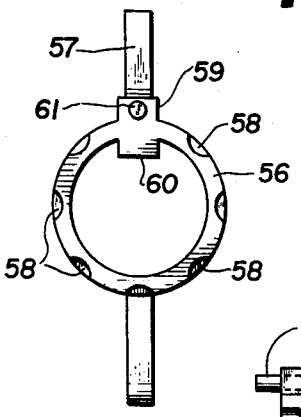
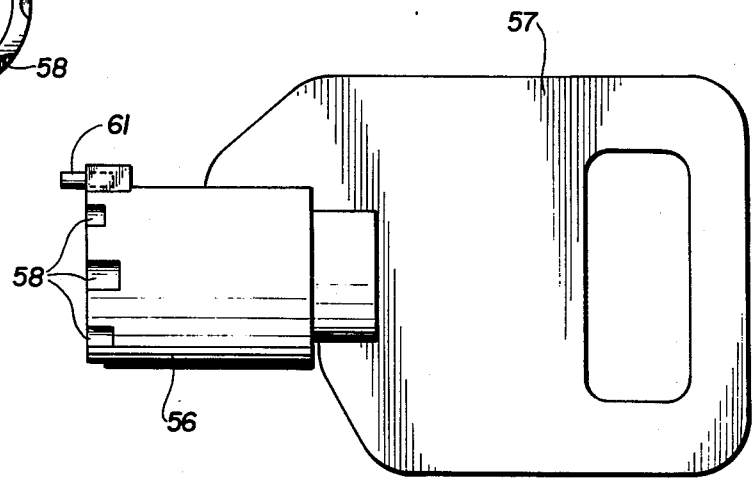
FIG. 5
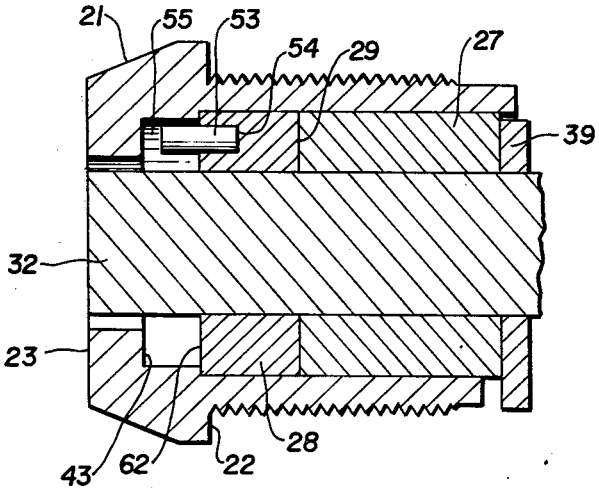
FIG. 6

TAMPER-PROOF AXIAL TUMBLER TYPE LOCK

BACKGROUND OF THE INVENTION

The invention seeks to improve on a special class of locks known in the art as "Ace" locks manufactured and sold by Chicago Lock Co., Chicago, Ill. Examples of the patented prior art pertaining to this particular class of locks are the following U.S. Pat. Nos.: 3,267,706; 3,270,538; 3,541,819; 3,813,906; 3,916,657.

As evidenced by these patents, pick or tamper proof features for "Ace" locks are known in the prior art and the principal objective of this invention is to improve on the prior art by lessening the complexity of the structures involved to render the locks pick-proof, while at the same time rendering it even more difficult to defeat the lock even though a much more simplified and economical mechanism is utilized.

Other important features and advantages of the invention will appear to those skilled in the art during the course of the following description.

SUMMARY OF THE INVENTION

A fixed lock casing contains an axially divided cylinder having stationary and rotational sections. Within axially registering tumbler bores of the two-part cylinder, a circumferential set of conventional divided tumblers bridge the shear line of the cylinder under influence of springs to render the lock active and are depressed to the shear line by a tubular key during release of the lock. The lock cylinder contains an additional special divided tumbler having a forward reduced pin extension inaccessible to a regular key but depressable to the cylinder shear line by a special key embodied in the invention and having a forward pin extension to engage the reduced pin extension of the special tumbler whereby the rotational section of the cylinder can be released. As an added safeguard, one or more hidden tumblers are contained in the fixed section of the lock cylinder and under the influence of a spring or springs can move forwardly into the tumbler bores of the rotational cylinder section if the proper key is not used or if the forward section of the special tumbler is not depressed properly to the shear line, the hidden tumbler or tumblers then also defeating picking of the lock.

BRIEF DESCRIPTION OF THE DRAWINGS

FIG. 4 is an end elevation of the key in FIG. 1.

FIG. 5 is a side elevation of the key.

FIG. 6 is a fragmentary section similar to FIG. 3 taken on the plane of line 6—6 in FIG. 2.

DETAILED DESCRIPTION

Figure 1:
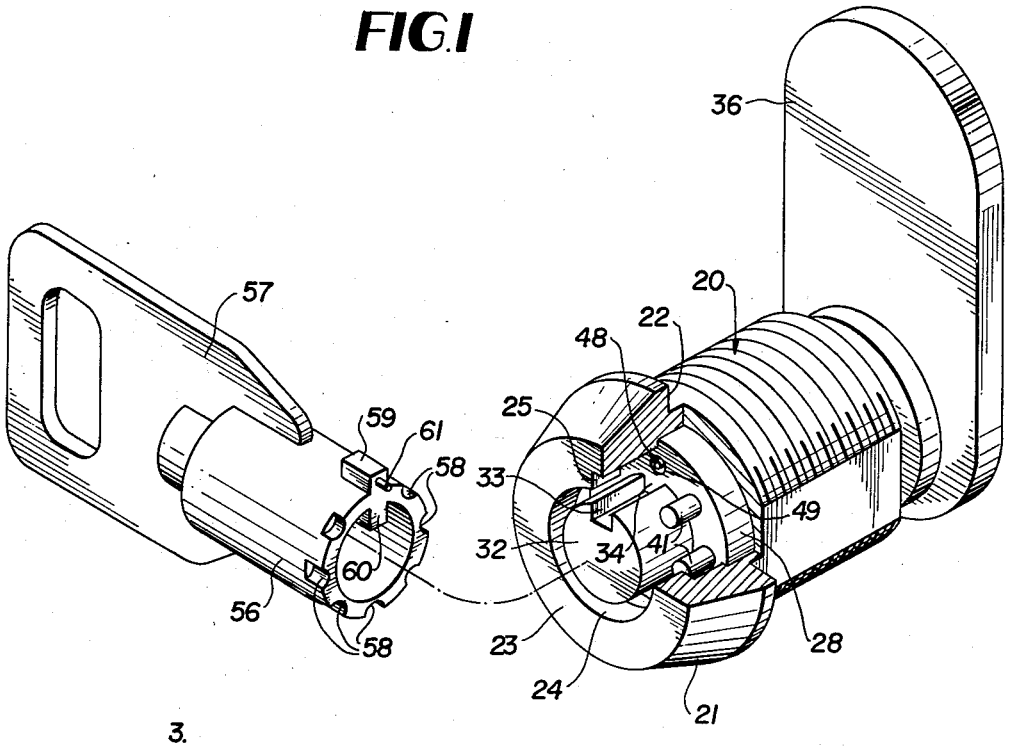
FIG. 1 is an exploded perspective view, partly in cross section, of a lock and key which embody the invention.

Referring to the drawings in detail, wherein like numerals designate like parts, an axial tumbler or "Ace" lock embodying the invention comprises a threaded casing 20 by means of which the lock can be installed on a vending machine door or other chosen place of usage. The casing 20 has a forward preferably tapered head 21 of enlarged diameter to provide a rear abutment shoulder 22 for installation purposes. The head 21 has a forward annular flange 23 including a bore 24 of somewhat reduced diameter and said bore being provided at one point with a rectangular cross section keyway 25 extending through the flange 23 axially, for a purpose to be described.

The lock casing 20 has a main bore 26 receiving a rear immovable lock cylinder section 27 and a forward rotational cylinder section 28 meeting the immovable cylinder section 27 on an annular shear line or interface 29. The immovable section 27 is conveniently held against movement in the casing 20 by a set screw 30 or other equivalent means. The forward face of rotational cylinder section 28 abuts an internal annular shoulder 31 of the lock casing 20.

The lock embodies the customary center post or stem 32 having a rectangular cross section keyway 33 formed in its forward end and extending longitudinally of the post for a sufficient distance to receive an internal key 34 of the rotational cylinder section 28, whereby rotation of the cylinder section 28 will produce rotation of the post 32.

The post 32 extends rearwardly through a bore 35 of the immovable cylinder section 27 and beyond the rear end of the casing 20 where the customary swingable lock plate 36 or bolt is keyed and attached to a screw-threaded extension 37 of the post 32 in the customary manner by a nut 38 and associated washer means 39 and 40, as illustrated. The lock plate 36 rotates with the post 32 and rotational cylinder section 28 responsive to the operation of a key, yet to be described.

Figure 2:
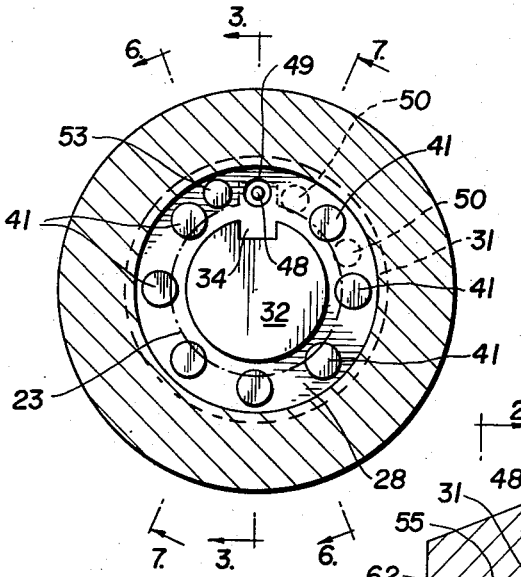
FIG. 2 is an enlarged transverse section, partly in elevation, taken on line 2—2 of FIG. 3.
Figure 3:
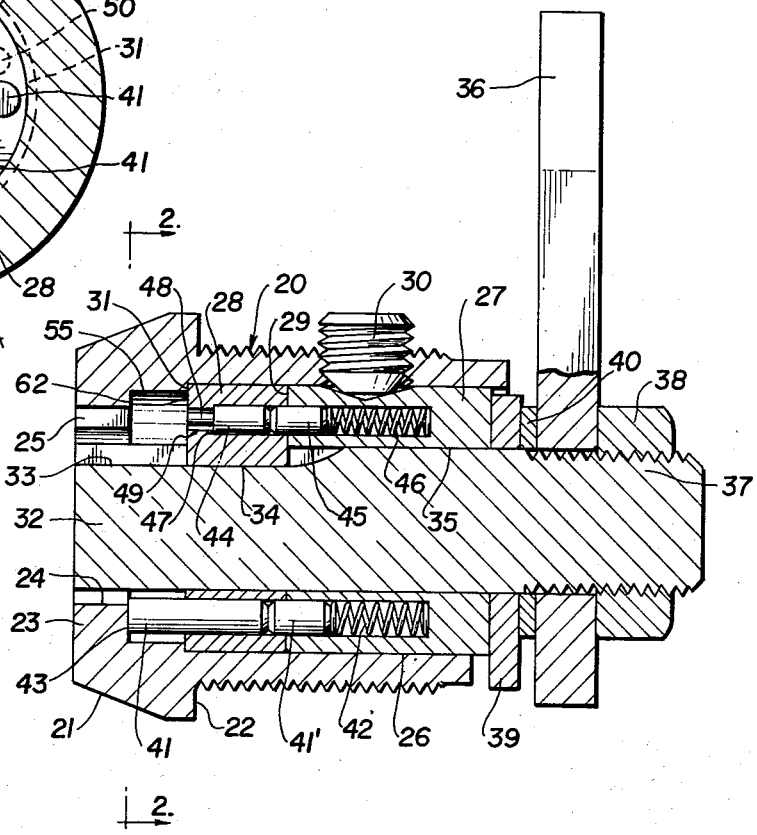
FIG. 3 is a longitudinal vertical section taken on line 3—3 of FIG. 2.
Figure 8:
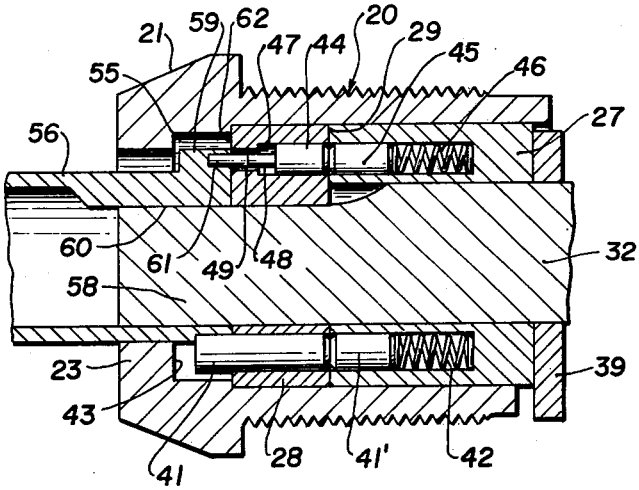
FIG. 8 is a similar section with the key inserted and depressing the special tumbler and regular tumblers to the shear line.
Figure 9:
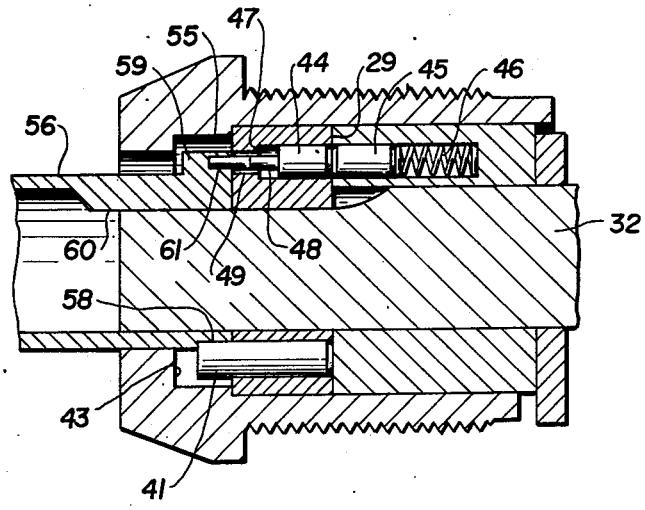
FIG. 9 is a similar view showing the rotational lock cylinder section rotated by means of the key to the plane of FIG. 7.

The lock embodies a plurality of circumferentially spaced regular or conventional tumbler pins 41 which are seven in number in the illustrated embodiment of the invention, FIG. 2. As shown in FIGS. 3, 8 and 9, the regular tumbler pins 41 are longitudinally divided and include rear pin sections 41' backed up by expansion springs 42 which urge the regular tumbler pins 41 forwardly into contact with an annular back shoulder 43 of the head flange 23. In such positions, the pin extensions 41 bridge the shear line 29 of the lock cylinder and thus the lock is rendered active. The two cylinder sections 27 and 28 have appropriate registering axially extending bores to receive the springs 42 and regular tumbler pins 41–41' slidably as illustrated.

Additionally, as shown in the drawings, a special or modified tumbler in the form of divided tumbler pin sections 44 and 45 is provided and forms an important feature of the invention. The tumbler pin sections 44 and 45 are urged forwardly by a spring 46 contained along with the elements 44 and 45 in another bore of the lock cylinder arranged between one pair of bores which receive two of the regular tumbler pins 41, FIG. 2. The forward pin section 44 of the special tumbler normally abuts an internal shoulder 47 of the rotational cylinder section 28 and a small diameter extension 48 on the forward pin section 44 extends through a forward opening 49 of cylinder section 28 and normally lies flush with the forward face of the section 28, as shown in FIG. 3, so as to be inaccessible by a conventional key.

It should also be observed that the forward flange 23 indicated by the phantom line in FIG. 2 overlaps and conceals all but small interior segments of the regular tumbler pins 41 and the special tumbler composed of pin sections 44 and 45, while leaving a sufficient annular passage between the post 32 and bore 24 for the insertion of a special key, to be described.

Figure 7:
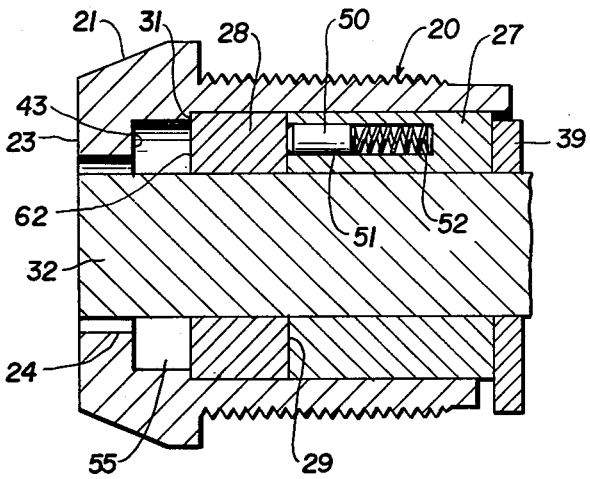
FIG. 7 is a similar section taken on the plane of line 7—7 in FIG. 2.

The invention further comprises at least one and, in the illustrated embodiment, FIGS. 2 and 7, a plurality of hidden tumblers 50 in circumferentially spaced relation intervened with the regular and special tumblers 41 and 44 on the same pitch circle, or a separate pitch circle in some cases. The hidden tumblers 50, FIG. 7, lie entirely behind the rotational cylinder section 28 and are contained in an additional bore or bores 51 of the stationary cylinder section 27, together with back-up springs 52 urging the hidden tumblers forwardly. The operation of the hidden tumbler or tumblers 50 in the pick-proof lock will be described.

With reference to FIGS. 2 and 6, the lock additionally comprises a single stop pin 53 held within an axial socket 54 in the rotational cylinder section 28 and projecting forwardly thereof into the chamber 55 formed by the casing head 21. The purpose of this stop pin in the lock structure is to prevent rotation of the key and the cylinder section 28 by a foreign or improper key or other lock-picking means.

The key forming another main feature of the invention and shown in FIGS. 1, 4 and 5 comprises a cylindrical tubular shank 56 equipped at its rear end with a turning handle 57. At its forward end, the tubular shank 56 has the customary circumferentially spaced axially extending arcuate recesses 58 to receive and operate the regular tumbers 41, above-described. Additionally, the shank 56 carries an external rectangular key 59 and a radially aligned internal key 60 at its forward end to enter the keyways 25 and 33 of the lock casing and the post 32 when the tubular key is inserted in the lock. The external key 59, FIGS. 8 and 9, enters the chamber 55 of the casing upon full insertion and if the key is then rotated relative to the casing 20, its external key 59 will be trapped inwardly of the flange 23 after moving out of registration with the keyway 25.

The key additionally comprises a small diameter pin 61 or extension element at the forward end of the external key 59 and anchored therein. The pin 61 projects axially a slight distance ahead of the leading end of shank 56 and is positioned on the shank to register with and abut the opposing end of the pin extension 48 of special tumbler section 44, FIGS. 8 and 9. In this manner, when the key is inserted into the lock, the pin 61 is able to force back the special tumbler 44–45 to the shear line 29 at the same time that the regular tumblers 41–41' are shifted to the shear line by the key recesses or sockets 58.

OPERATION

With the key removed from the lock and all of the regular tumblers 41–41' and the special tumbler 44–45 bridging the shear line 29, as shown in FIG. 3, the lock is active and the plate 36 and post 32 will not turn. The hidden tumbler or tumblers 50 remain positioned as in FIG. 7 behind the shear line 29 and entirely out of view.

When the special key is introduced through the annular space between the bore 24 and post 32, its keys 59 and 60 enter through the keyways 25 and 33 and the pin 61 will abut and force back the pin extension 48 of the special tumbler 44–45 until its two sections are at the shear line 29, FIG. 8. Simultaneously, the key through its recesses 58 forces back all of the regular tumblers 41–41' to the shear line, as shown in FIG. 8. The key can now be rotated in the proper direction which is clockwise, FIG. 2, to turn the cylinder section 28 and post 32 with lock plate 36 to the release or unlocked position.

When the proper key is utilized in the proper manner, the lock will open and it is virtually impossible to pick or defeat the lock because of the provision of the described special tumbler 44–45 requiring the use of the special key with small extension pin 61. However, in the unlikely event that someone with skill in picking locks should succeed in depressing the regular tumblers 41–41' and the special tumbler 44–45 to the shear line, FIG. 8, and if an attempt were then made to rotate the post 32 and cylinder section 28, the hidden tumbler 50 under spring compression would pop into the rear of the bore containing special tumbler pin section 44 and maintain the lock active before the plate 36 could reach the release position. In short, it requires the special key of the invention in the lock, as shown in FIGS. 8 and 9, and maintaining the divided regular and special tumblers on the shear line 29 before the lock can be opened. If the proper key is not used and somehow the lock picker succeeds in starting to turn the cylinder section 28, the hidden tumbler or tumblers 50 will operate automatically as described and prevent defeating of the lock.

If the proper key is used as shown in FIG. 8 and rotation is started, but inadvertently the key is somewhat retracted but not removed, the hidden tumbler or tumblers 50 can move into one of the tumbler bores of cylinder section 28 and reset the lock and in such a case the key will be trapped inside of the head 21 and in and of itself will protect against lock picking.

In summation, therefore, the main features of the invention are the provision in the lock of the special tumbler 44–45, the hidden tumbler or tumblers 50, and the stop pin 53, together with the addition of the pin 61 on the tubular shank of the key. By virtue of these few additions, the invention is very compatible on a production basis and very adaptable to the conventional and very popular "Ace" locks. The invention cures the well recognized weakness of this type of lock, namely, that it is not difficult to pick it.

It should be noted in connection with the use of the special key that the outer end face 62 of rotational cylinder section 28 limits penetration of the key into the lock accurately so that all of the depressed tumblers will be on the shear line 29, FIG. 8, when the key is fully inserted.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A tamper-proof lock comprising a relatively stationary casing, fixed and rotational cylinder sections within the casing having axially extending tumbler bores, a set of regular axially divided tumblers within said tumbler bores of said cylinder section and normally bridging a shear line face between said cylinder sections when the lock is active, a special axially divided tumbler within tumbler bores of said cylinder sections including a leading part which is flush with the outer end face of the rotational cylinder section, an axial post and laterally extending lock plate keyed to the rotational cylinder section to turn therewith, and a key for opening the lock including a tubular shank to engage over the post and into the casing and into abutment with the outer end face of the rotational cylinder section, the key having leading end peripheral recesses to engage and depress said regular tumblers to said shear line face and having a pin extension projecting forwardly of the leading end of said tubular shank and engaging said leading part of said special axially divided tumbler to depress the special tumbler to said shear line face when said key is fully inserted into the lock, whereby the key is then able to rotate the rotational cylinder section with said post and lock plate, and said special tumbler leading part including a reduced diameter forward section axially aligned with and adapted to be abutted by the leading end of the pin extension of said key, said rotational cylinder section having an axial opening into which said reduced diameter forward section of the special tumbler extends flush with the outer end face of the rotational cylinder section and an internal shoulder in the tumbler bore of the rotational cylinder section which receives the special tumbler and limiting forward movement of the special tumbler in such tumbler bore.

2. A tamper-proof lock as defined in claim 1, and exterior and interior keying elements on the tubular shank of said key at its leading end, said post and lock casing having keyways formed therein adapted to receive said keying elements, said casing having a leading end flange through which the keyway of the casing extends and an enlarged chamber inwardly of the flange receiving the exterior keying element when the key is fully inserted into abutment with the outer end face of the rotational cylinder section, and said pin extension of the key fixed to the exterior keying element and projecting forwardly thereof.

3. A tamper-proof lock as defined in claim 1, and a stop element carried by said rotational cylinder section and extending beyond the forward end face thereof and into a chamber of said casing and being in the path of movement of an exterior keying element on the shank of an unauthorized key to block rotation of such a key in one direction beyond a point at which said rotational cylinder section becomes relocked by a hidden tumbler.

4. A tamper-proof lock as defined in claim 1, and at least one hidden tumbler within an axial tumbler bore of the fixed cylinder section and adapted during rotation of the rotational cylinder section to automatically enter the bore of the special tumbler if the leading part of the special tumbler is not fully depressed to said shear line face.

* * * * *